US005307616A

United States Patent [19]

Goineau et al.

[11] Patent Number: 5,307,616

[45] Date of Patent: May 3, 1994

[54] METHOD TO MANUFACTURE A SLUB YARN

[75] Inventors: Andre' M. Goineau, Spartanburg; William F. Southerlin, Travelers Rest, both of S.C.

[73] Assignee: Milliken Research Corporation, Spartanburg, S.C.

[21] Appl. No.: 743,681

[22] Filed: Aug. 12, 1991

[51] Int. Cl.[5] ..... D02G 3/36

[52] U.S. Cl. ..... 57/284; 57/91; 57/206

[58] Field of Search ..... 57/91, 206, 208, 284, 57/287, 288, 289

[56] References Cited

U.S. PATENT DOCUMENTS

| | | | |
|---|---|---|---|
| 3,104,516 | 9/1963 | Field | 57/208 X |
| 3,805,344 | 4/1974 | Bartnichi et al. | 57/91 X |
| 4,124,973 | 11/1978 | Hense et al. | 57/208 X |
| 4,160,359 | 7/1979 | Frentress | 57/91 X |
| 4,351,148 | 9/1982 | Eschenbach | 57/208 X |
| 4,567,720 | 2/1986 | Price | 57/91 X |
| 4,790,132 | 12/1988 | Nelson | 57/284 |

*Primary Examiner*—Daniel P. Stodola
*Assistant Examiner*—Michael R. Mansen
*Attorney, Agent, or Firm*—Terry T. Moyer; Earle R. Marden

[57] ABSTRACT

Method to provide a novel false twisted slub yarn by combining a core yarn and an effect yarn in a fluid tangling zone. The linear velocity of the effect yarn is raised to allow slubs to be produced in the combined yarn in an air jet apparatus. The slub yarn is then run through a commingling air jet after formation of the slubs to commingle the lean portion of the yarn between the slubs formed to prevent a strip back of the yarn during weaving and/or knitting.

3 Claims, 2 Drawing Sheets

FIG. —1—

METHOD TO MANUFACTURE A SLUB YARN

This invention relates generally to novelty yarns produced by combining a false twisted core yarn and a false twisted effect yarn in an air jet to supply a continuous, multi-filament slub yarn.

It is therefore an object of the invention to provide an apparatus and method to produce a novelty, multi-filament yarn.

Figure 1:
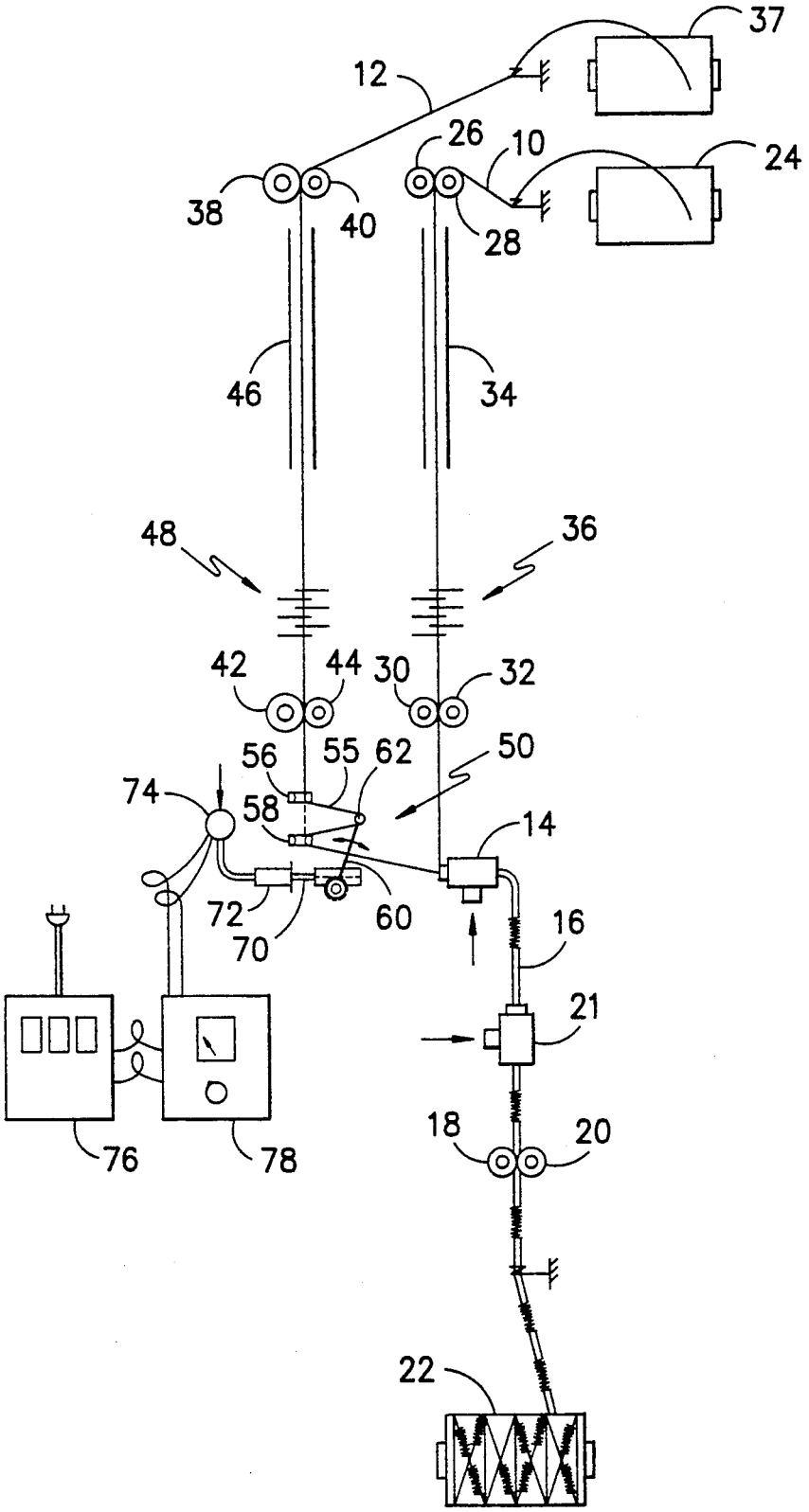
Figure 2:
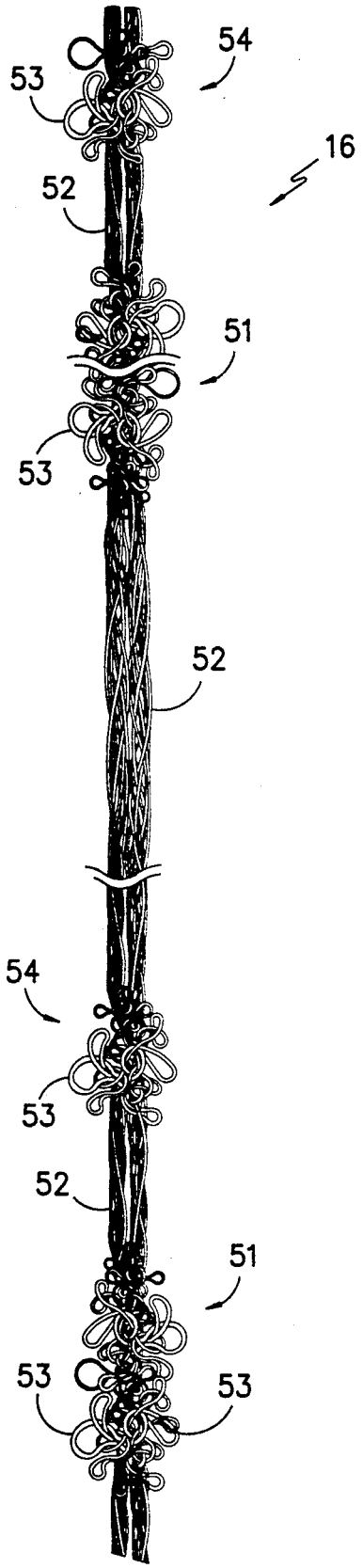
Figure 3:
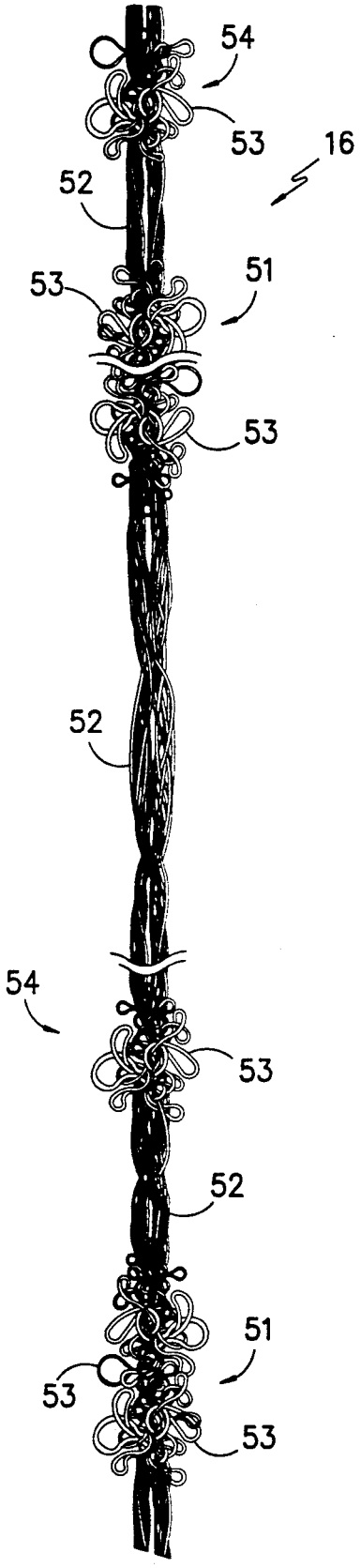

Other objects and advantages of the invention will become readily apparent as the specification proceeds to describe the invention with reference to the accompanying drawings, in which:

FIG. 1 is a schematic representation of the apparatus and method to produce the novel yarn, and FIG. 2 is a schematic representation of the yarn produced by the first air jet of FIG. 1 and FIG. 3 is a schematic representation of the yarn after it passes through the second commingling air jet.

Looking now to FIG. 1 there is shown one embodiment of an apparatus for producing novelty yarn composed of a core yarn and an effect yarn. In the preferred form of the invention, both the core yarn 10 and the effect yarn 12 are continuous, multi-filament, partially oriented polyester yarns but, obviously, other partially oriented or fully oriented synthetic, continuous, multi-filament yarns such as nylon, Dacron, etc. can be employed, if desired.

The core and effect yarns 10 and 12 are combined in the air jet 14 to produce the slub yarn 16 which is delivered by the takeup nip rolls 18 and 20 through the secondary air jet 21 to the takeup roll 22. The core yarn 10 is delivered from the package 24 to the false twist zone by the first delivery rolls 26 and 28. The second delivery rolls 30 and 32 draw the core yarn 10 as it passes through the primary heater 34 and the false twist device 36, illustrated as friction discs, and supplies it to the air jet 14.

The effect yarn 12 is delivered from the package 37 to the false twist zone by the first delivery rolls 38 and 40 and is drawn by the second delivery rolls 42 and 44 as it passes through the primary heater 46 and false twist device 48, illustrated as friction discs. From the delivery rolls 42 and 44, the effect yarn 12 is delivered to the air jet 14 through the path deviation device 50 which operates in a manner hereinafter explained.

The speeds of the delivery rolls are pre-selected to provide a desired result in the yarn produced. In the preferred form of the invention, the speed of the rolls 26, 28, 38 and 40 is so selected that the speed of the effect yarn 12 being delivered thereby is the speed of the core yarn 10. The speeds of the delivery rolls 30, 32, 42 and 44 are so selected that the delivery speed of the effect yarn 12 is the speed of the core yarn 10. In the preferred form of the invention, since partially oriented yarn is being run, the speeds of rolls 30, 32, 42 and 44 are so selected to draw the effect and core yarns. The speed of the delivery rolls 18 and 20 is so selected that the slub yarn 16 delivered therefrom is at a speed lower than the speed of either the core yarn 10 or the effect yarn 12, respectively, from the rolls 30 and 32 or 42 and 44.

The combined slub yarn 16 exiting from the air jet 14 consists of slub sections 51, lean sections 52 and nubs 54. The slub sections 51 and the nubs 54 are denser than the lean sections and contain a plurality of substantially circular loops 53 having a diameter range of 0.003" to 0.010". As will be hereinafter explained the length of the slub sections and lean sections is randomly selected, but the nubs shall always be shorter in length than the slubs and closely adjacent thereto.

The slubs sections 51 and nubs 54 are basically allowed to form by the path deviation device 50 which controls the path and consequently the velocity of the effect yarn 12. The core yarn 10 is supplied directly from the delivery rolls 32 into the entrance of the air jet 14 while the effect yarn 12 is supplied from the delivery rolls 42 and 44 through the guide members 56 and 58 then into the air jet. When the path deviation device 50 is not actuated the yarn 12 will pass straight downwardly through the guide members 56 and 58, and then be directed into the conventional air jet 14 wherein it is commingled with the core yarn 10 to form yarn represented by the lean section 52. After the yarn 16 is formed in the air jet 14 it is passed through a commingling air jet 21 to especially commingle the lean sections 52 as shown in FIG. 3 to interlock same so that they do not strip back when the yarn is used to weave or knit a fabric.

The yarn deviation device 50 consists of a rod with an elongated body portion 60 and a finger portion 62 perpendicular to the body portion 60. The rod is connected to the piston rod 70 of an air cylinder 72 supplied air under pressure through a solenoid operated valve 74. The actuation of the solenoid valve is controlled by a random signal generator 76 of the type disclosed in U.S. Pat. No. 4,160,359 which randomly supplies pulses to the DC power supply 78 to cause power to be supplied randomly to the solenoid valve 74. When the solenoid valve is activated, air is supplied to air cylinder 72 to move the piston rod 70 outwardly to the position shown in FIG. 1 to pivot the rod 60 to the position shown. When the rod 60 is pivoted, the finger portion 62 contacts the effect yarn 12 and lengthens the path of travel thereof. By lengthening the path of travel of the yarn 12 in this manner, the linear velocity in this manner, the linear velocity of the effect yarn being supplied to the air jet 14 is reduced to about the linear velocity of the core yarn 10. When the solenoid valve 74 is deactivated, the air will be exhausted from the air cylinder 72 and a spring (not shown) will immediately retract the rod releasing the yarn 12 between the guide members 56 and 58. When the yarn 12 is released the accumulated yarn loop 55 and the excess yarn therein is sucked into the air jet and the filaments therein are expanded and allowed the curl into the substantially circular yarn loops 53 which are intermingled with the filaments of the core yarn 10 until the excess yarn in the loop 55 is taken up and the velocity of the core and effect yarns stabilizes and forms a lean section 52.

The following is an example of the production of a slub yarn in the manner hereinbefore described.

The core and effect yarns are both 106 denier, 34 filament, 56T, partially oriented polyester yarn. The resultant combined yarn is 170 denier polyester yarn having slubs in the range of 2"–4½" in length and nubs in the range of ½" to ¾" in length.

The combined yarn is formed under the following parameters:

Effect yarn velocity from first delivery rolls—298 meters/minute

Core yarn velocity from first delivery rolls—248 meters/minute

Primary heater temperature—200° C.

Effect yarn velocity from second delivery rolls—446 meters/minute

Core yarn velocity from second delivery rolls—371 meters/minute

Stroke of rod 60—3"

Air pressure to air texturing jet—120 psi

Air pressure to commingling air jet—40 psi

Random signal generator on for about 0.15 to 0.30 seconds and off for 0.02 seconds Combined yarn velocity from take-up rolls—293 meters/minute Combined yarn take-up velocity—339 meters/minute It is obvious that a false twist textured slub yarn has been provided by efficiently combining a core yarn and an effect yarn in a novel apparatus which employs air under pressure to commingle and slub the filaments of the core and effect yarns.

Although the preferred embodiment of the invention has been described specifically, it is contemplated that many changes may be made without departing from the scope or spirit of the invention, and we desire to be limited only by the claims.

I claim:

1. A method of making a slub yarn having a first yarn and a second yarn comprising the steps of: feeding a first yarn at a first predetermined rate to an air texturing jet, simultaneously feeding a second yarn to the air texturing jet at a second predetermined rate, supplying air at a pressure above 100 psi to the air texturing jet to form a composite yarn, withdrawing the composite yarn from the air texturing jet at a third predetermined rate which is lower than the first or second predetermined rate, periodically reducing the second predetermined rate by increasing the yarn path of the second yarn and allowing the increased yarn path to suddenly return to the original yarn path to form slubs in the composite yarn in the air texturing jet and passing the slubbed yarn through an air commingling jet being supplied air at a pressure substantially lower than the air being supplied to the air texturing jet, to commingle the yarn between the formed slubs to prevent strip back during later processing.

2. The method of claim 1 wherein the second predetermined rate is higher than the first determined rate.

3. The method of claim 2 wherein the second predetermined rate is periodically reduced down to the first predetermined rate.

* * * * *